US006461215B1

(12) United States Patent
Kunz et al.

(10) Patent No.: US 6,461,215 B1
(45) Date of Patent: Oct. 8, 2002

(54) TOY BUILDING SET COMPRISING A TUBULAR, ELONGATED, FLEXIBLE TOY BUILDING ELEMENT, AND SUCH A TOY BUILDING ELEMENT

(75) Inventors: Philippe Kunz, Ebertswil; Heinz Looser, Zug, both of (CH); Sten Schmidt, Grindsted (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/508,810

(22) PCT Filed: Sep. 17, 1998

(86) PCT No.: PCT/DK98/00399

§ 371 (c)(1),
(2), (4) Date: Jul. 10, 2000

(87) PCT Pub. No.: WO99/16521

PCT Pub. Date: Apr. 8, 1999

(30) Foreign Application Priority Data

Sep. 18, 1997 (DK) ..... 1073/97

(51) Int. Cl.[7] ..... A63H 33/08

(52) U.S. Cl. ..... 446/107; 446/102; 446/103; 446/124

(58) Field of Search ..... 446/100, 107, 446/104, 103, 102, 119, 120, 121, 126, 89, 197, 128

(56) References Cited

U.S. PATENT DOCUMENTS

| | | | | |
|---|---|---|---|---|
| 853,756 A | * | 5/1907 | Betis | 446/102 |
| 3,153,300 A | * | 10/1964 | Keech | 446/199 |
| 3,205,611 A | | 9/1965 | Onanian | |
| 3,918,196 A | * | 11/1975 | Schleich | 46/22 |
| 3,975,858 A | * | 8/1976 | Much | 46/26 |
| 4,579,538 A | * | 4/1986 | Bass et al. | 446/107 |
| 5,009,599 A | * | 4/1991 | Mueller | 446/122 |
| 5,042,972 A | * | 8/1991 | Bach et al. | 446/91 |
| 5,071,384 A | * | 12/1991 | Poulsen | 446/103 |
| 5,073,138 A | * | 12/1991 | Klitsner et al. | 446/103 |

FOREIGN PATENT DOCUMENTS

| | | |
|---|---|---|
| DE | 3401 318 A1 | 11/1984 |
| DK | 161497 B | 7/1991 |
| EP | 0 511 501 A1 | 11/1992 |

* cited by examiner

*Primary Examiner*—Derris H. Banks
*Assistant Examiner*—Urszula M Cegielnik
(74) *Attorney, Agent, or Firm*—Pitney, Hardin, Kipp & Szuch LLP

(57) ABSTRACT

A toy building set comprising toy building elements (1, 3, 5, 6, 7, 9, 10, 11) which may be coupled together to build structures. Some of the toy building elements are in the form of shafts (5) and bushings (7) which are capable of coupling other toy building elements together, as these other toy building elements are provided with coupling means which are complementary to said shafts (5) and bushings (7). The toy building set also comprises at least one tubular, elongated, flexible toy building element (6) which essentially has a uniform cross section over its entire length, and whose end faces appear as clean cuts perpendicular to its longitudinal direction. This tubular, elongated, flexible toy building element (6) has such an inner shape that it may be coupled together with said shafts (5) and bushings (7) by gripping at least a portion of these.

4 Claims, 4 Drawing Sheets

1/4

Figure 1:
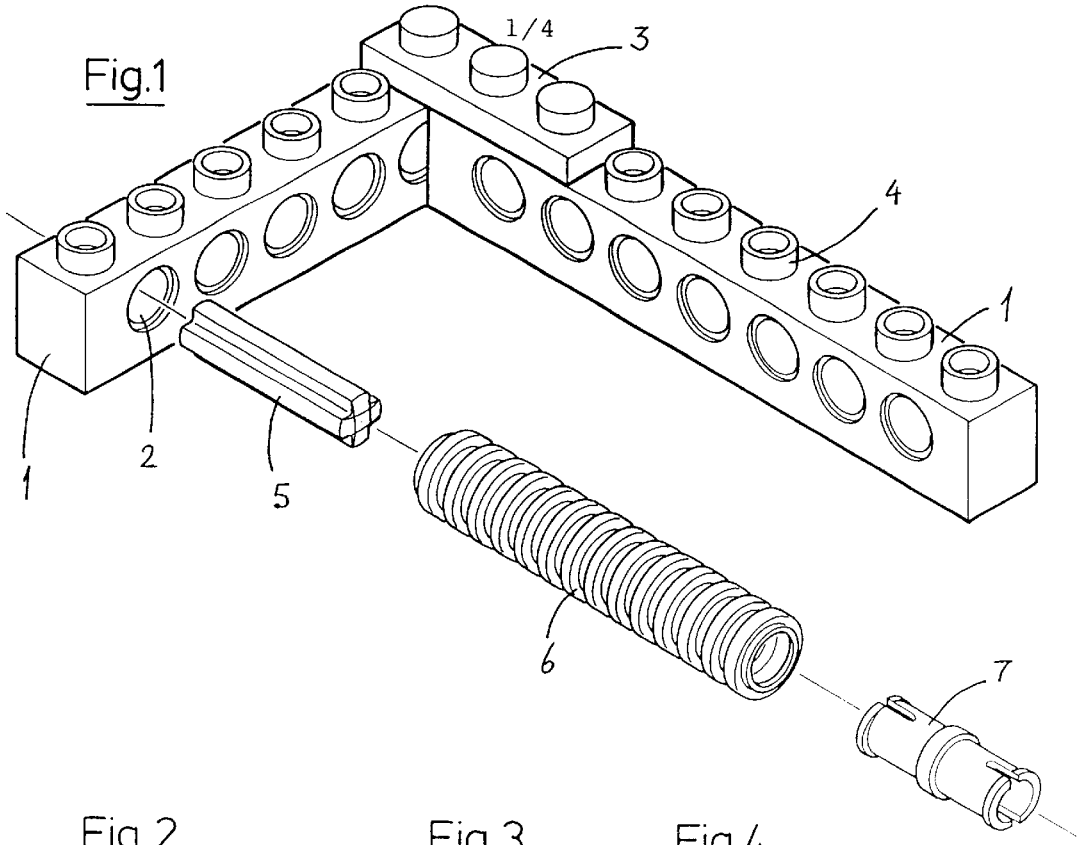

3
4
1
1
2
5
6
7

5
1
6

C
5

1
7
6
8

3
1
5
6
7

TOY BUILDING SET COMPRISING A TUBULAR, ELONGATED, FLEXIBLE TOY BUILDING ELEMENT, AND SUCH A TOY BUILDING ELEMENT

The invention relates to a toy building set as defined in the introductory portion of claim 1.

Such toy building sets are generally known under names such as LEGO Technic, said toy building sets including traditional toy building elements in the form of box-shaped building blocks provided with coupling studs on the upper side and complementary coupling means on the lower side. Some of these traditional toy building sets may moreover be provided with through holes, so that they may also be interconnected laterally by means of special bushings. LEGO Technic, e.g., additionally includes shafts, gear wheels, etc., and the toy building set thus comprises may special elements, thereby enabling larger and more complex structures to be built than is possible with traditional box-shaped toy building elements.

Further, a toy building element has been developed particularly for LEGO Technic, consisting of a relatively rigid and smooth plastics pipe of small diameter and of uniform cross-section over its entire length. The plastics pipe may be coupled internally in other toy building elements adapted for the purpose, and by bending the plastics pipe between its connections with other toy building elements it is possible to build structures which incorporate rounded shapes.

Also other tubular, flexible toy building elements for toy building sets are known. U.S. Pat. No. 4,579,538, DE C2 3 401 318 and NO B 117 109 disclose flexible toy building elements which each consist of a tubular body which, at the ends, is provided with special coupling means for connection with other toy building elements. The flexible toy building elements are moreover constructed such that they may be caused to assume arbitrary configurations without being held at both ends, as their bellows-shaped structure allows the links to assume fixed positions relatively to each other.

U.S. Pat. No. 3 605 323 discloses another flexible toy building element which does not comprise a tubular body, but a coil spring having special coupling means at the ends. This flexible toy building element will not be able to assume arbitrary configurations without being held at both ends, as the spring effect will always try to straighten the toy building element.

It is common to all the last-mentioned toy building elements that they are provided with special coupling means at the ends, which partly make their construction complicated and partly limit the possibilities of play and building, since they will always assume the same length and can only be coupled together with quite specific coupling means on the other toy building elements which are included in the toy building set concerned.

In contrast to this, the previously mentioned flexible pipe for LEGO Technic is formed with end faces which appear as clean cuts perpendicular to its longitudinal direction, thereby allowing the pipe to be easily shortened, as desired and needed. This toy building element, however, also just gives limited possibilities of play and building, as it can only be coupled together with other toy building elements at the ends of the pipe. The free portion will therefore always assume its most natural shape, e.g. as a curve or a straight portion.

The object of the present invention is to provide a toy building set comprising a tubular, elongated, flexible toy building element, which toy building set is to present more possibilities of play and building than the known toy building sets having flexible toy building elements.

This is achieved by arranging the toy building set stated in the opening paragraph as defined in the characterizing portion of claim 1.

Arranging the toy building set in this manner provides a toy building set which contains a tubular, elongated, flexible toy building element whose outer shape may be determined by the shafts and bushings of the toy building set. Thus, with the disclosed toy building set it is possible selectively to determine the outer shape of the tubular, elongated, flexible toy building element e.g. by allowing shafts and/or bushings to extend a certain distance into the tubular, elongated, flexible toy building element. If desired, it is of course also possible exclusively to connect the tubular, elongated, flexible toy building element with the shafts and bushings of the toy building set at its ends, so that it merely assumes its most natural position in the same manner as is known from the pipe of LEGO Technic.

Finally, according to the invention, the tubular, elongated, flexible toy building element may be shortened to any length, as its ends appear as clean cuts perpendicular to its longitudinal direction.

Preferably, the tubular, elongated, flexible toy building element has a circular cross-section whose inner diameter essentially corresponds to the smallest circle that may be circumscribed by the shafts and bushings of the toy building set. If the inner diameter of the tubular, elongated, flexible toy building element is formed slightly smaller than corresponds to the smallest circle that may be circumscribed by the shafts and bushings of the toy building set, a relatively tight coupling may be achieved between the tubular, elongated, flexible toy building element and the shafts and bushings of the toy building set, so that the tubular, elongated, flexible toy building element may be held securely.

If the coupling between the shafts and the tubular, elongated, flexible toy building element is suitably tight, it is even possible to use the tubular, elongated, flexible toy building element as a flexible shaft capable of transferring rotational movements.

In a particularly preferred embodiment, the tubular, elongated, flexible toy building element is corrugated in its entire length. This results in a toy building element which is very flexible, and which may be compressed as well as be stretched in its axial direction. This adds considerably to the possibilities of play and building.

If the tubular, elongated, flexible toy building element is corrugated in its entire length, the bushings may advantageously have a circular cross-section and be provided, at each of its outer ends, with a radially protruding bead which, upon connection with the tubular, elongated, flexible toy building element, snaps into the corrugations of the tubular, elongated, flexible toy building element. The holding force against axial displacement is hereby increased considerably.

If the shafts consist of cross shafts, they may preferably be circumscribed by a circle which corresponds to the inner circular cross-section of the tubular, elongated, flexible toy building element. In a particular embodiment, the parts are arranged such that a tight coupling may be achieved between the cross shafts and the tubular, elongated, flexible toy building element.

The invention also relates to a toy building element for a toy building set comprising shafts and bushings.

Figure 2:
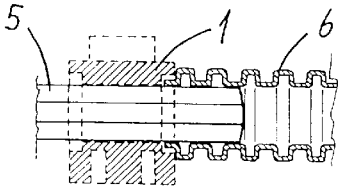
Figure 3:
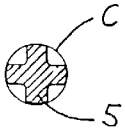
Figure 4:
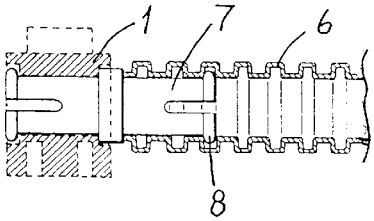
Figure 5:
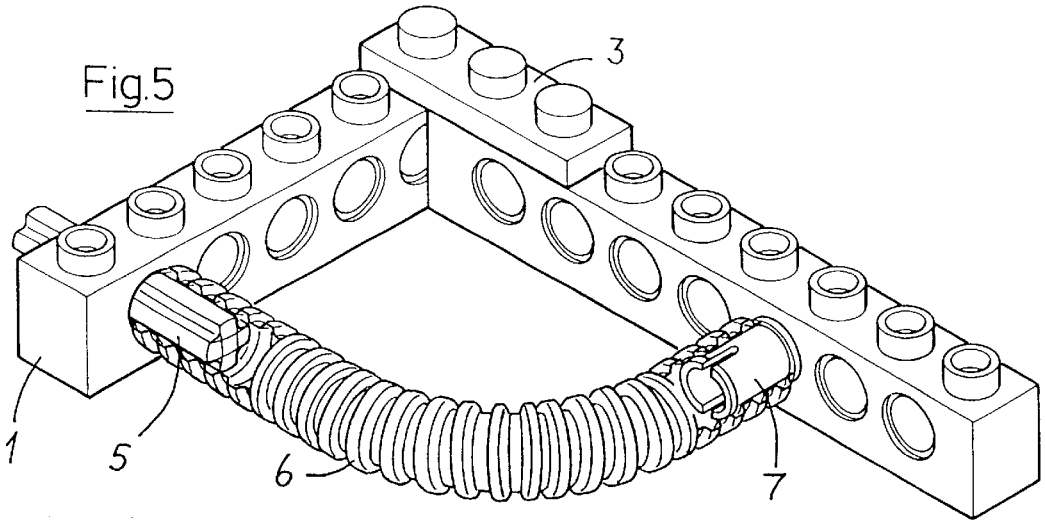
Figure 10:
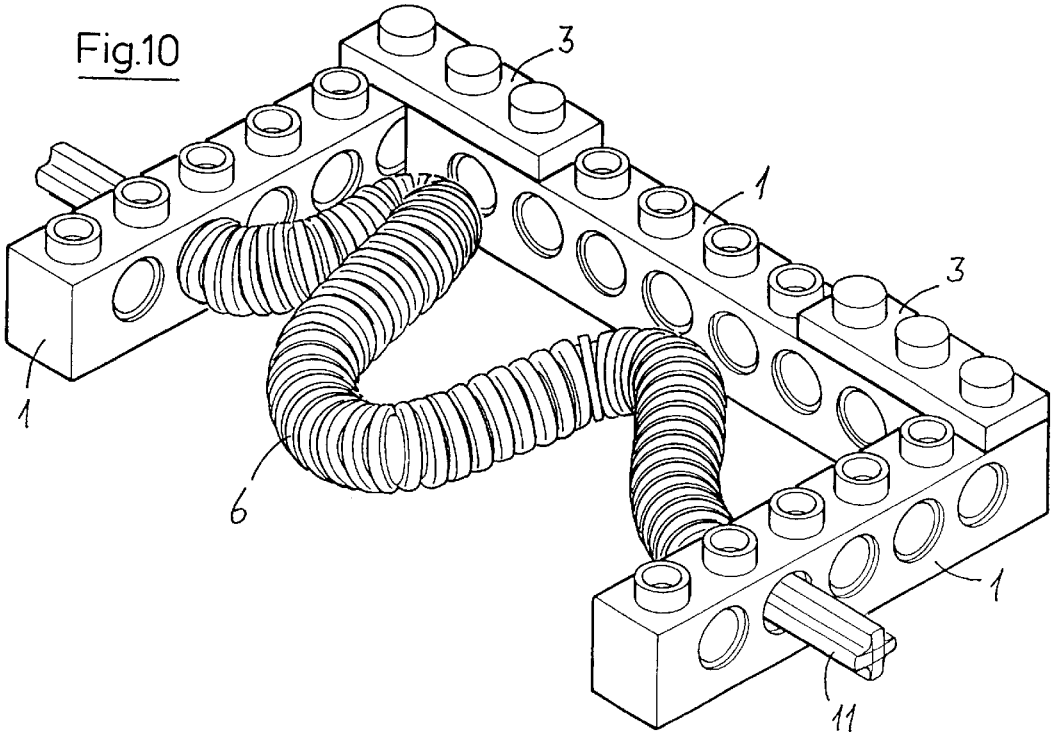
Figure 11:
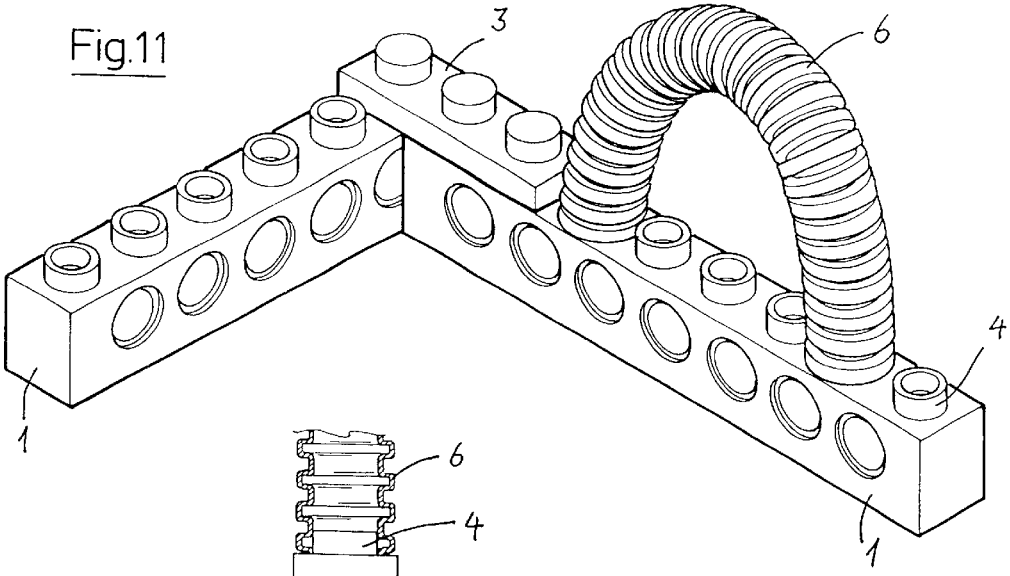
Figure 12:
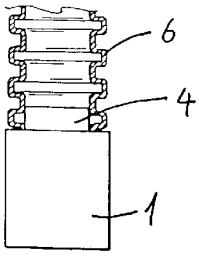

The invention will now be explained more fully with reference to the drawing, in which FIG. 1 shows various toy building elements for a toy building set according to the invention, FIG. 2 shows a section through the tubular, elongated, flexible toy building element pushed inwardly over the end of a cross shaft, FIG. 3 shows a cross-section of a cross shaft with its smallest circumscribed circle, FIG. 4 shows a section through the tubular, elongated, flexible toy building element pushed inwardly over a bushing, FIG. 5 shows the toy building elements shown in FIG. 1 in a concrete structure with the tubular, elongated, flexible toy building element as an essential element, FIGS. 6–11 show various alternative uses of the tubular, elongated, flexible toy building element together with various other toy building elements which are incorporated in the toy building set, and FIG. 12 shows a section through the tubular, elongated, flexible toy building element coupled on a coupling stud.

FIG. 1 shows various toy building elements for a toy building set according to the invention. The toy building elements comprise two box-shaped toy building elements 1 with through holes 2. The two box-shaped toy building elements 1 are assembled at a right angle with a third box-shaped toy building element 3 by conventional coupling means in the form of coupling studs 4 and complementary coupling means at the bottom of the toy building element 3 (not shown).

The toy building elements moreover comprise a cross shaft 5, a tubular, elongated, flexible toy building element 6 and a bushing 7.

With the exception of the tubular, elongated, flexible toy building element 6, the mentioned toy building elements as such are known from the toy building set known under the name of LEGO Technic.

In the shown embodiment, the tubular, elongated, flexible toy building element 6 has a circular cross-section and is provided with corrugations over its entire length. It is preferably made of a relatively soft plastics material, and for convenience it will just be called the "groove pipe 6" below.

The groove pipe 6 may be coupled together with the cross shaft 5 merely by being pushed inwardly over it, as shown in FIG. 2, in which a cross-section of a toy building element is shown in dashed line.

In a particular embodiment, a relatively tight fit is established between the groove pipe 6 and the cross shaft 5, as the smallest inner diameter of the groove pipe 6 corresponds to or is slightly smaller than the smallest circumscribed circle C of the cross shaft 5, which is illustrated in FIG. 3 that shows a cross-section of a cross shaft 5.

In the same manner as with the cross shaft, the groove pipe 6 may be coupled together with the bushing 7 merely by being pushed inwardly over one end thereof, as shown in FIG. 4. At the end, the bushing 7 is preferably provided with a radially protruding bead 8 which snaps into the corrugations of the groove pipe 6 and thus increases the resistance against axial withdrawal. The diameter of the bushing 7 preferably corresponds to or is slightly smaller than the smallest inner diameter of the groove pipe 6.

In FIG. 5, the toy building elements shown in FIG. 1 are assembled in a concrete structure, the groove pipe 6 being coupled together with the cross shaft 5 and the bushing 7 as just described. The cross shaft 5 is arranged loosely in a hole 2 in one of the box-shaped toy building elements 1, while the bushing 7 is coupled together with the other toy building element 1, as the end which has not been pushed into the groove pipe 6 has been passed through a hole 2. For clarity, a portion of the groove pipe 6 is removed to illustrate the cross shaft 5 and the extent of the bushing 7 in it.

As will appear, the cross shaft 5 extends further into the groove pipe 6 than the bushing 7, which contributes to determining the shape assumed by the groove pipe 6. By allowing the cross shaft 5 and/or the bushing 7 to extend a longer or shorter distance into the groove pipe 6 it is possible to determine the shape of the groove pipe 6, that is to say where it is to present straight portions, and where it is to present curved portions.

Figure 6:
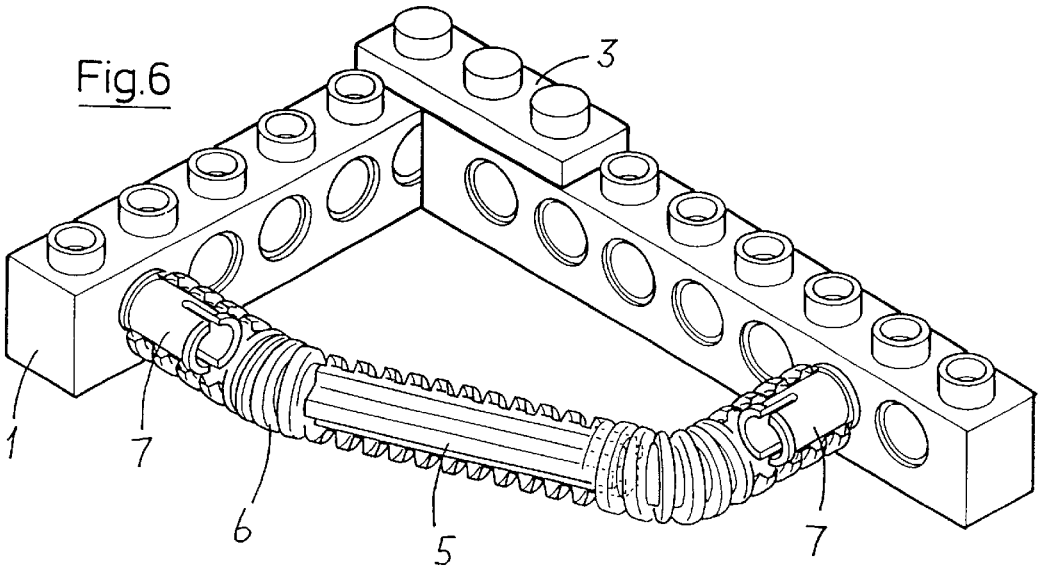

An alternative use of the groove pipe 6 is shown in FIG. 6, where it is used together with two bushings and a cross shaft 5. In this structure, the cross shaft 5 is inserted right into the centre of the groove pipe 6, while the two bushings 7 are inserted into the ends of the groove pipe 6. With such a structure, the groove pipe 6 may be forced to exhibit a rectilinear central portion.

Figure 7:
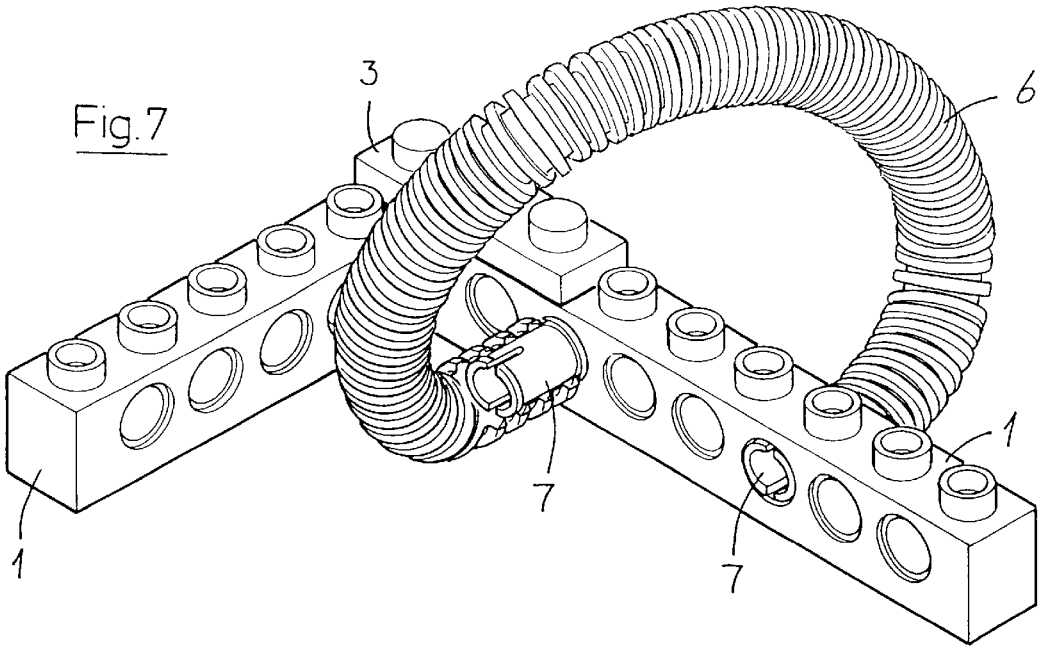

FIG. 7 shows still another alternative structure in which the groove pipe 6 is coupled together with a bushing 7 at each end, and in which these bushings 7 are then coupled together with a toy building element 1 on each side.

Figure 8:
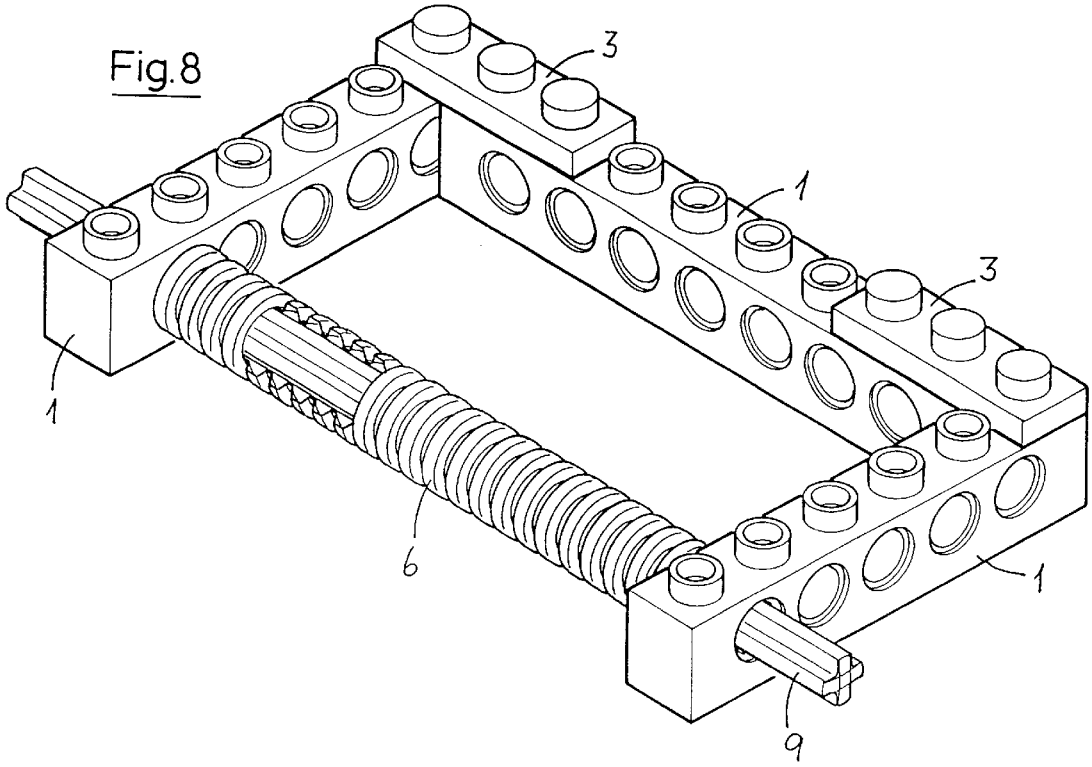

FIG. 8 shows a fourth structure in which a long cross shaft 9 is pushed right through the groove pipe 6, so that it protrudes from both ends thereof. The groove pipe 6 may hereby be built into a structure in which it presents a long straight portion.

Figure 9:
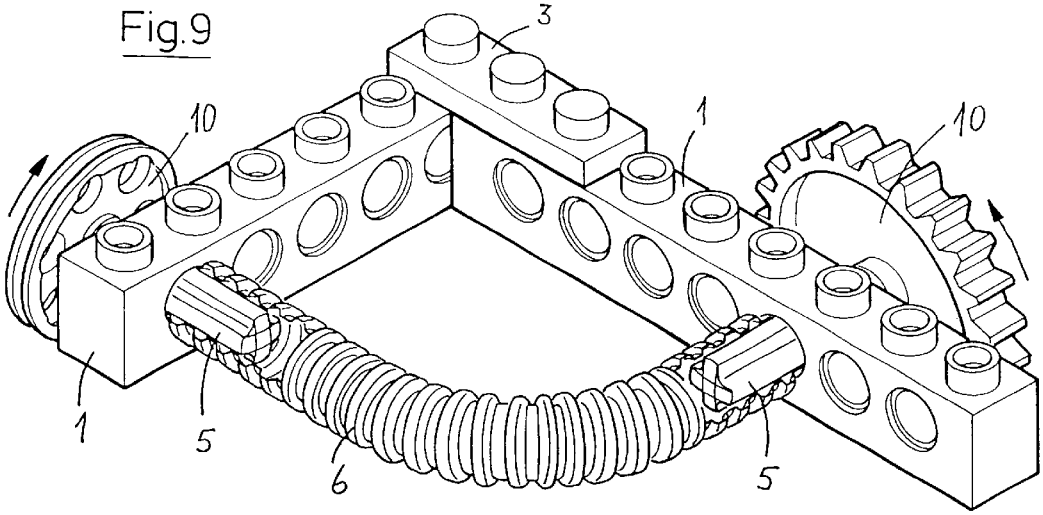

If the fit between the groove pipe 6 and the cross shafts 5 is sufficiently tight, the groove pipe 6 may be used as a flexible shaft capable of transferring rotational forces. Such a use is shown in FIG. 9. The groove pipe 6 is here pushed inwardly over two cross shafts 5 which each are coupled together with a rotary element 10, which may e.g. be a wheel and a gear wheel as shown. The size of rotational forces that can be transferred via the groove pipe 6, depends partly on the rotational friction between the groove pipe 6 and the cross shafts 5 and partly on the torsional rigidity of the groove pipe 6.

The rotational friction between the groove pipe 6 and the cross shafts 5 is proportional to the distance which the groove pipe 6 has been pushed inwardly over the cross shafts 5, and this may thus be varied. Hereby, it is possible in principle to use this coupling between the groove pipe 6 and the cross shafts 5 as a kind of frictional coupling.

FIG. 10 shows a use of the groove pipe 6 which in principle corresponds to the use shown in FIG. 8. The groove pipe 6 is here pushed inwardly over a shaft 11 which is shaped as a cross shaft at the ends, while the central portion is shaped as a round rod. The central portion is moreover provided with curves, so that the groove pipe 6 pushed inwardly over this part assumes corresponding curves. With this use of the groove pipe 6 it is moreover possible to achieve an additional visual effect if the shaft 11 is simultaneously used as a shaft for rotary movements.

FIG. 11 illustrates still another alternative use of the groove pipe 6 in the building of various structures, the groove pipe being here coupled on the coupling studs 4 of the toy building elements 1. Of course, this can be done only if the coupling studs 4 have such a shape that the groove pipe 6 fits tightly over these. FIG. 12 is a sectional view of this coupling between the groove pipe 6 and a coupling stud 4. To be used in this manner, the length of the corrugations of the groove pipe 6 must be adapted to the height of the coupling stud 4, just as its smallest inner diameter must be adapted to the diameter of the coupling stud 4.

The tubular, elongated, flexible toy building element 6 is called the "groove pipe" in the foregoing and with reference to the drawing, as it is provided with corrugations (grooves) in its entire length in the shown embodiment.

However, nothing prevents the tubular, elongated, flexible toy building element from being formed with a smooth surface, externally as well as internally. Such a shape, however, will make the tubular, elongated, flexible toy building element considerably less flexible than the shape as a groove pipe.

The cross-section of the tubular, elongated, flexible toy building element need not be circular either, as other cross-sections, e.g. a square or cross-shaped one, will also be within the scope of the invention. An essential feature of the tubular, elongated, flexible toy building element is that it has an essentially uniform cross-section in its entire length, and that its ends appear as clean cuts perpendicular to its longitudinal direction, so that it may readily be shortened, if desired.

In addition, it is essential that shafts and/or bushings can be inserted into the tubular, elongated, flexible toy building element and in this manner determine its outer shape.

What is claimed is:

1. A toy building set comprising a plurality of toy building elements arranged to be releasably coupled together to build structures, wherein at least one of said plurality of toy building elements is a tubular, elongated, flexible toy building element having an opening with a circular inner cross section passing therethrough, and plane end faces which are perpendicular to a longitudinal direction of said tubular, elongated, flexible toy building element, and wherein at least some of the toy building elements include shafts and bushings that each has a cross section that generally equals or is smaller than said circular inner cross section of said tubular, elongated, flexible toy building element, such that said tubular, elongated, flexible toy building element can be releasably coupled to said shafts and bushings by gripping at least a portion thereof, at least one of said shafts having a cross section over an entire length thereof that equals or is smaller than said circular inner cross section of said tubular, elongated, flexible toy building element whereby any portion of said shaft selectively may be positioned within the tubular, elongated, flexible toy building element.

2. A toy building set according to claim 1, wherein the tubular, elongated, flexible toy building element has a corrugated inner and outer surface over an entire length thereof.

3. A toy building set according to claim 2, wherein each end of the bushings has a circular cross-section and it further includes, at an outer end, a protruding bead which, upon connection with the tubular, elongated, flexible, toy building element cooperates with said corrugated inner surface.

4. A toy building set according to any one of claims 1–3, wherein said shafts include cross shafts wherein a circumscribed circle equals said circular inner cross section of said tubular, elongated, flexible toy building element.

* * * * *